US005312271A

United States Patent [19]

Matsumoto et al.

[11] Patent Number: 5,312,271

[45] Date of Patent: May 17, 1994

[54] PIN PLUG

[75] Inventors: Hiroichi Matsumoto; Masaki Matsukawa, both of Tokyo, Japan

[73] Assignee: SDK Company, Ltd., Tokyo, Japan

[21] Appl. No.: 971,180

[22] Filed: Nov. 3, 1992

[30] Foreign Application Priority Data

Aug. 10, 1992 [JP] Japan ..... 4-070333[U]

[51] Int. Cl.[5] ..... H01R 13/00

[52] U.S. Cl. ..... 439/578

[58] Field of Search ..... 439/578-585, 439/675

[56] References Cited

U.S. PATENT DOCUMENTS 4,129,352 12/1978 Iizuka ..... 439/675
4,859,197 8/1989 Toramoto et al. ..... 439/675
4,995,836 2/1991 Toramoto ..... 439/675

FOREIGN PATENT DOCUMENTS 63-25668 10/1988 Japan .

*Primary Examiner*—Joseph H. McGlynn
*Attorney, Agent, or Firm*—Dickstein, Shapiro & Morin

[57] ABSTRACT

A pin plug is a connector which is inserted into a jack etc. In the pin plug, a cylindrical sleeve portion and an insulator body for fixing the sleeve portion and a metal center pin are integrally formed with rigid resin to form an insulator. Moreover, a flexible metal contact piece is attached to an opening portion formed at a part of the sleeve portion, and a non-rigid resin cover engages the outside of the insulator and the contact piece. When the thus constructed pin plug is inserted into a jack, a good electric contact state can be obtained between the pin plug and jack owing to the resiliency of the contact piece and the cover, and the pin plug can be inserted into or extracted from the jack with ease.

3 Claims, 8 Drawing Sheets

PIN PLUG

BACKGROUND OF THE INVENTION

1. Field of the Invention

The present invention relates to a pin plug which is a connecting apparatus to be connected to a jack, etc., for connecting electric components to each other.

2. Description of the Related Art

There were pin plugs of this kind such as disclosed in the following literatures;

Literature 1: Japanese Utility Model Publication No. 63-25668

Literature 2: Electronic Industries Association of Japan Specification "RC-6703A pin connector for electronic components" (1988-7) published by Electronic Industries Association of Japan (Inc.) Technical Department.

FIG. 1 is a longitudinal cross-sectional view of a conventional pin plug described in the literature 1 set forth above and FIG. 2 is an enlarged cross-sectional view thereof cut along II—II line.

The pin plug 10 is inserted into or extracted from, for example, a jack 20. The jack 20 comprises a cylindrical metal sleeve 21 and a female electric contact 22 which is fixed in the metal sleeve 21 by way of an insulator.

The pin plug 10 comprises a cylindrical metal sleeve 11 which is inserted outside the sleeve 21 of the jack 20, a metal center pin 12 which is arranged along the axis of the sleeve 11 and contacts the female electric contact 22 of the jack 20, an insulator 13 which electrically insulates the sleeve 11 from the center pin 12 and fix them to each other and a synthetic resin cover 14 which engages the outside of the sleeve 11.

The sleeve 11 includes a cylindrical head portion 11*a* and a cord clamping portion 11*b* extended therefrom, both of which are, for example, made of a sheet of metal plate. The cylindrical head portion 11*a* is formed of a sheet of metal plate machined into a cylindrical shape having a slit 11*c* therein. The cord clamping portion 11*b* of the sleeve 11 fixedly clamps a cord 30, and the second conductor of the cord 30 (e.g., a cable sheath) 32 is fixed to the cord clamping portion 11*b* by spot welding etc. A center pin 12 is arranged along the axis of the cylindrical head portion 11*a*. The center pin 12 is connected to a first conductor of the cord 30 (e.g., a cable core) 31 at the rear half portion thereof by spot welding etc., and the rear half portion of the center pin 12 and the sleeve 11 are fixed to each other by a resin insulator 13 so as to form a cylindrical form having the same diameter as that of the head portion 11*a*. A cover 14 engages the outside of the insulator 13 and the sleeve 11.

The assembling of the pin plug of this kind and the connection thereof to the cord 30 are performed as follows.

The center pin 12 is inserted into the head portion 11*a* of the sleeve 11 along the axis thereof and the cylindrical insulator 13 having the same diameter as that of the head portion 11*a* and fixing the rear half of the center pin 12 therein is formed between the head portion 11*a* and the cord clamping portion 11*b* by way of resin insert. Then the cord 30 piercing the cover 14 is clamped by the cord clamping portion 11*b* of the sleeve 11, the cable sheath 32 of the cord 30 is connected to the cord clamping portion 11*b* by spot welding etc., and the cable conductor 31 of the cord 30 is connected to the center pin 12 at the rear side surface thereof by spot welding etc.

Thereafter the cover 14 is forced to be put on the sleeve 11 from the rear side thereof toward the head portion 11*a* so as to cover the same. In this way the assembling of the pin plug and the connection of the cord 30 thereto are completed.

When the tip end of the center pin 12 of the thus assembled pin plug 10 is inserted into the female contact 22 of the jack 20, the sleeve 11 of the pin plug 10 engages the outside of the sleeve 21 of the jack 20, so that the center pin 12 of the pin plug 10 is electrically coupled to the female contact 22 of the jack 20 and the sleeve 11 of the pin plug 10 is electrically coupled to the sleeve 21 of the jack 20.

The conventional pin plug, however, had the following drawbacks.

In the conventional pin plug 10, the sleeve 11 is made of, for example, a sheet of metal plate by press molding, etc. for manufacturing simplification, cost reduction, etc. and has a cylindrically formed head portion 11*a*. Since the cylindrical head portion 11*a* is made of a sheet of metal plate, it has a slit 11*c*, which makes the head portion 11*a* displaceable and elastic in the radial direction thereof. The elasticity of the head portion 11*a* of the sleeve 11, however, is poor due to its construction.

The diameter of the head portion 11*a* of the sleeve 11 is determined by a technical standard as described in the literature 2, etc., set forth above, with a strict allowable error of, e.g., $\Phi$ 8.3±0.1 (mm). As a result, when the diameter of the head portion 11*a* of the sleeve 11 is too large due to a manufacturing variation, there occurs a defective electrical contact between the sleeve 21 of the jack 20 and itself. On the contrary, when it is too small, it can hardly be inserted into or extracted from the sleeve 21 of the jack 20. At that time, if the head portion 11*a* having a small diameter is forced to be set outside the sleeve 21 of the jack 20, there is a likelihood of defective electric contact between the sleeve 21 and itself since the sleeve 21 enlarges the slit 11*c* so that the head portion 11*a* is deformed to be elliptical in cross section and the contacting area between the head portion 11*a* and the sleeve 21 is lessened.

Moreover, there were drawbacks such as the poor corrosion resistance of the metal head portion 11*a* of the sleeve 11, and furthermore, the difficulty of coloring for color code identification of pin plugs.

It is the first object of the present invention to provide a pin plug which comprises a sleeve and an insulator integrally formed with a rigid resin and has a two-partitioned structure, so as to increase accuracy in the diameter of the cylindrical sleeve portion at manufacturing and be easily assembled without any specific tool.

It is the second object of the present invention to provide a pin plug comprising a flexible metal contact piece at the opening formed at a portion of the circumference of the cylindrical sleeve thereof and a non-rigid resin cover which presses the contact piece toward the axis of the insulator so as to enable the pin plug to be smoothly inserted into the sleeve etc. of the jack and extracted therefrom, and furthermore, to obtain a good electric contact between the sleeve of the jack and itself by the elasticity of the cover and the contact piece.

It is the third object of the present invention to provide a pin plug which is improved in corrosion resistance and easy coloring so as to be identified by a color code at the sleeve thereof with ease.

It is the fourth object of the present invention to provide a pin plug which can be manufactured more easily by integrally forming the insulator having a cylindrical sleeve portion by rigid resin molding so as to fix the metal contact piece and the center pin therein.

In order to achieve the above objects, the pin plug according to the present invention comprises a cylindrical sleeve to which a first conductor of a cord having the first and a second conductors therein is connected, a center pin disposed along the axis of the sleeve, one end of which projects from the sleeve and the other end of which is connected to the second conductor of the cord, an insulator for electrically insulating the sleeve from the center pin and for fixing them each other, and a non-rigid resin cover which engages the outside of the sleeve.

The sleeve and the insulator set forth above are integrally formed with rigid resin into a two-partitioned component, the sleeve includes an opening at a part of the circumference of the cylindrical sleeve portion thereof, and a flexible metal contact piece connected to the first conductor of the cord is attached to the opening so as to be radially displaceable.

The objects of the present invention set forth above, other objects and new characteristic thereof will be more completely understood by reading the following detailed description with reference to attached drawings. The drawings, however, is exclusively for explanation and does not limit the scope of the present invention thereto.

PREFERRED EMBODIMENTS OF THE INVENTION

Figure 1:
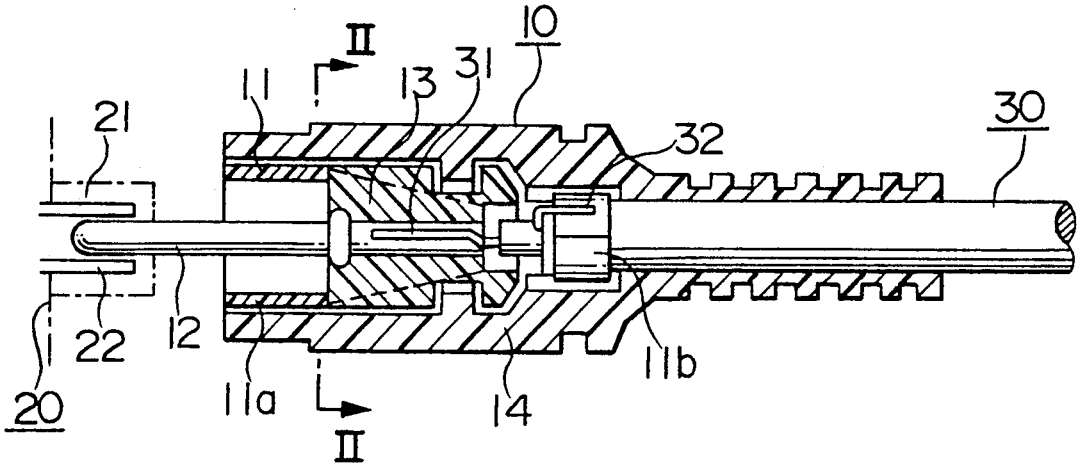
FIG. 1 PRIOR ART
FIG. 1 is a longitudinal cross-sectional view of a conventional pin plug.
Figure 2:
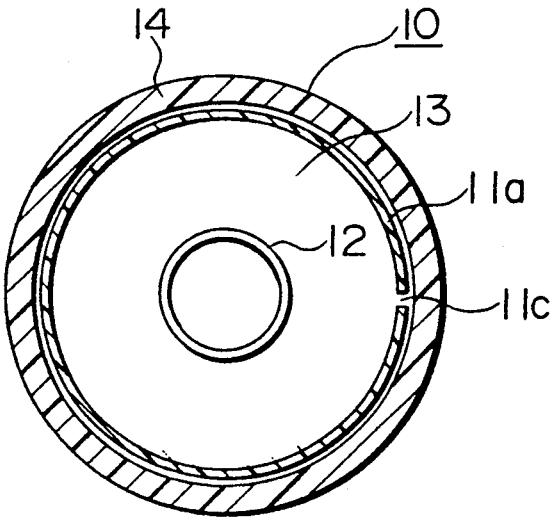
FIG. 2 PRIOR ART
FIG. 2 is an enlarged cross-sectional view cut along line II—II of the pin plug of FIG. 1.

The pin plug according to the first embodiment of the present invention includes a substantially cylindrical insulator 40 made of rigid resin such as polypropylene etc. A flexible metal contact piece 60 made of phosphor bronze etc. is attached to the side of the tip opening of the insulator 40 so as to contact the outside of the sleeve 21 of the jack 20 in FIG. 1, and a metal center pin 70 is fixed along the axis of the insulator 40 so as to contact the female contact 22 of the jack 20 in FIG. 1. The center pin 70 is connected to the first conductor (e.g., the cable core) 31 of the cord 30 and the contact piece 60 is connected to the second conductor (e.g., the cable sheath) 32 of the cord 30. A non-rigid resin cover 80 made of vinyl chloride etc. engages the outside of the insulator 40.

The insulator 40 includes a substantially cylindrical insulator body 42 made of two partitions which are closable about a hinge portion 41 which is a thin bendable connecting portion. A hooking portion 44 projects adjacent to a through hole 43 on one of the two partitions of the insulator body 42 to be freely inserted into or extracted from a retaining hole 45 formed on the other partition of the insulator body 42. A projection 46 is provided in the through hole 43 for retaining the center pin 70 thereby, and an annular groove 47 is formed outside the insulator 42 to engage the cover 80.

A cylindrical sleeve portion 48 having a two-partitioned structure extends at the tip end portion of the insulator body 42. An opening portion 49 for attaching the contact piece 60 thereto is formed at a portion of the sleeve portion 48 and at a portion of the insulator body 42 and a retaining recess 50 for retaining the contact piece 60 thereby is formed adjacent to the opening portion 49.

The contact piece 60 is attached to the opening portion 49 of the insulator body 40 so as to be arranged on the circumference substantially same as that of the sleeve 48. The contact piece 60 has a retaining convex portion 61 to engage the retaining recess 50 of the insulator 40 and a conductor clamping portion 62 for clamping the cable sheath 32 of the cord 30, the retaining convex portion 61 and the conductor clamping portion 62 extending from the rear end thereof as illustrated in FIGS. 4 and 5.

Figure 3:
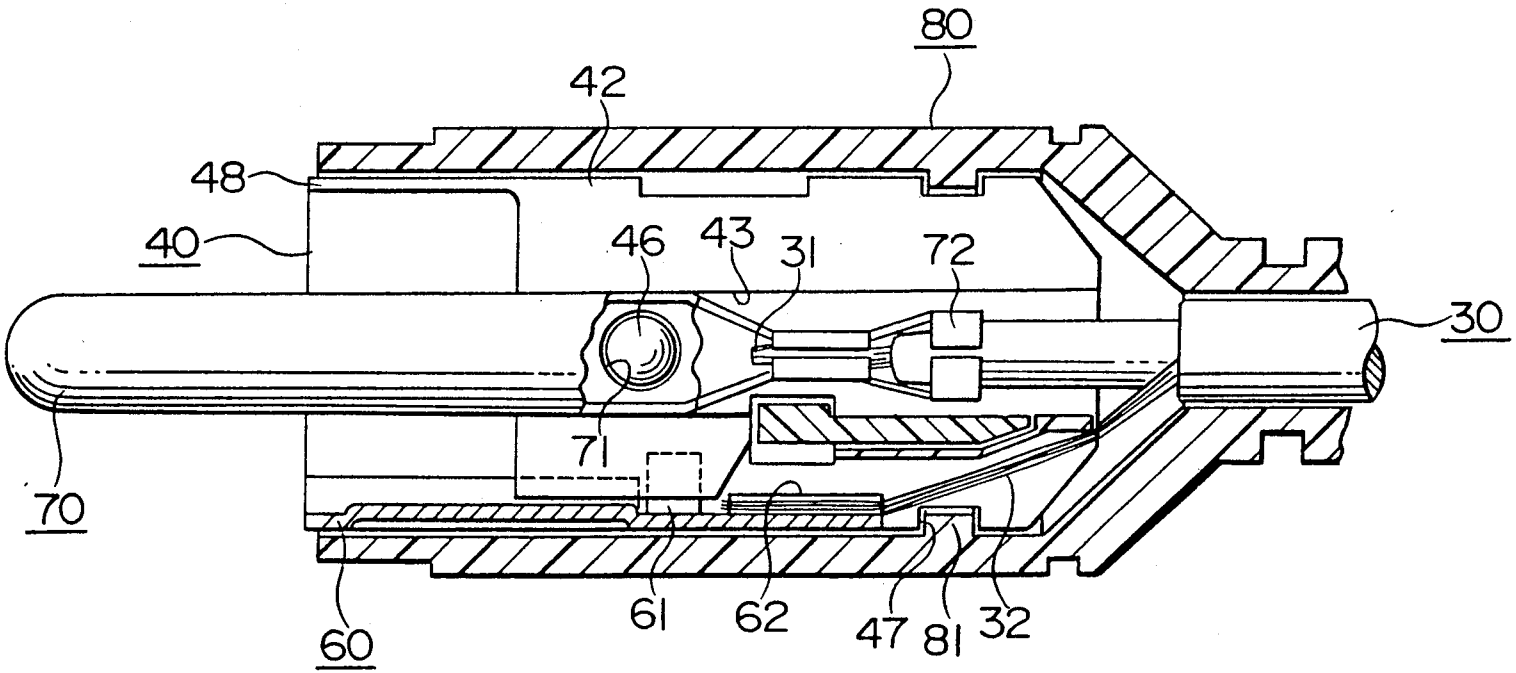
FIG. 3 is a longitudinal cross-sectional view showing a pin plug according to a first preferred embodiment of the present invention.
Figure 4:
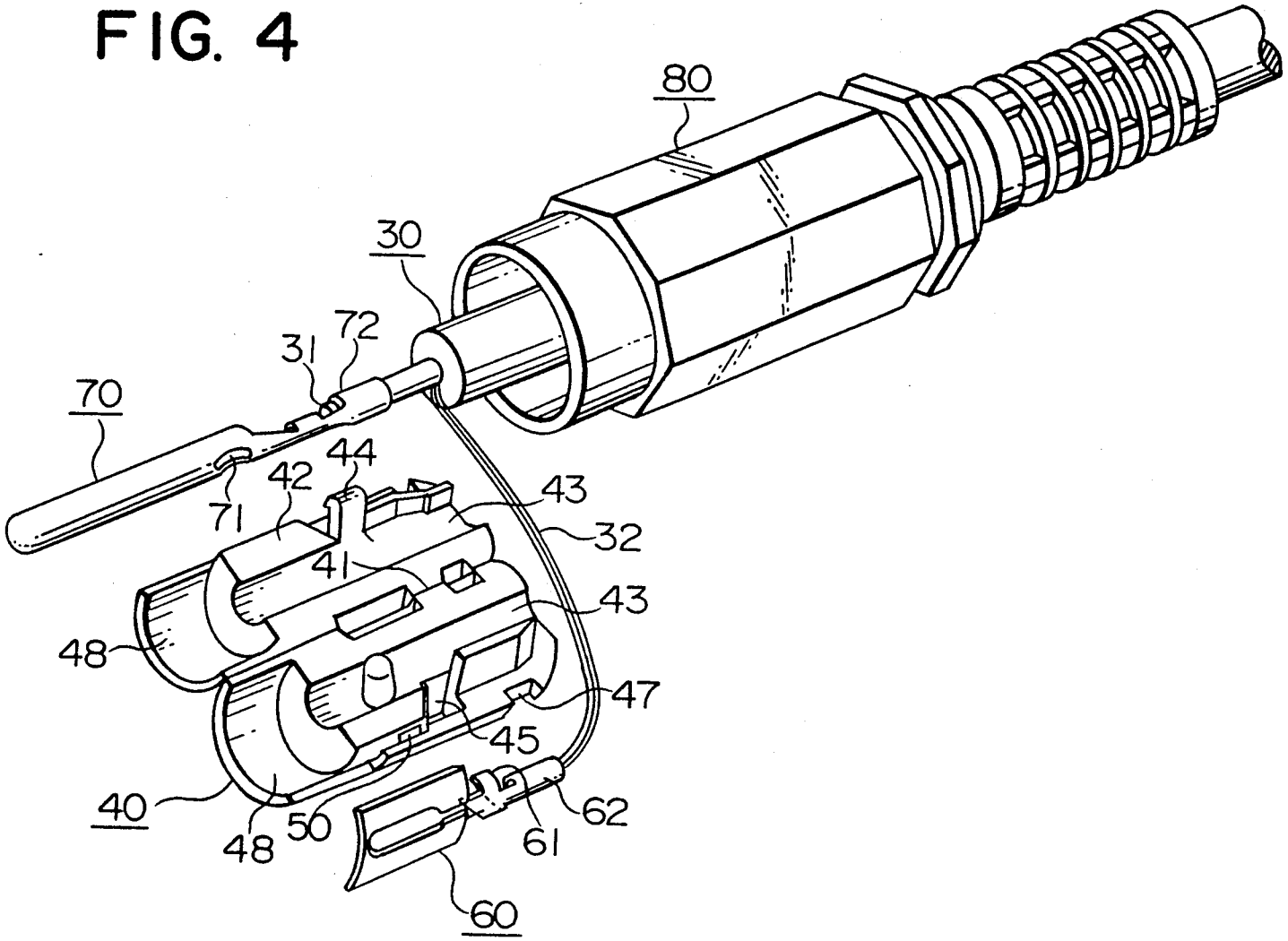
FIG. 4 is an exploded perspective view of the pin plug of FIG. 3.
Figure 5:
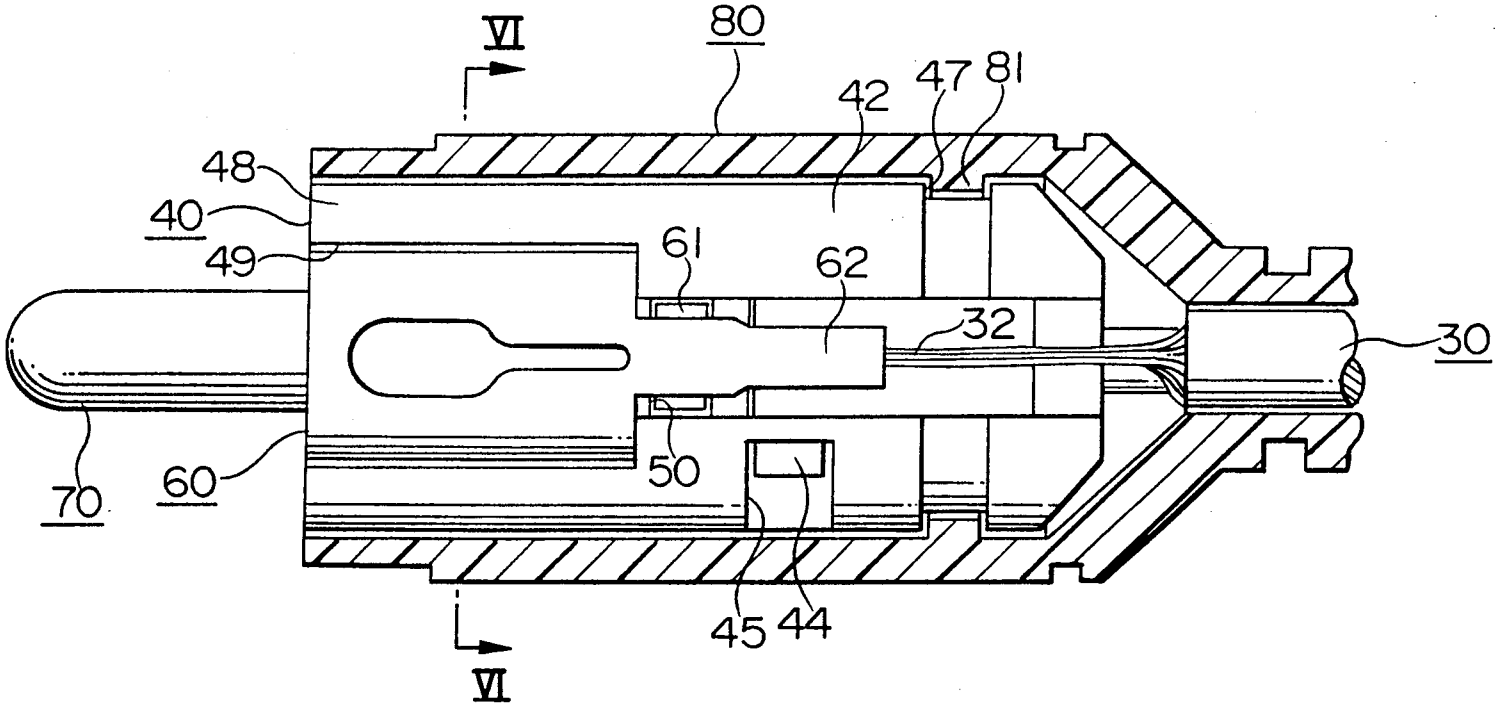
FIG. 5 is a lateral cross-sectional view of the pin plug of FIG. 3.

The center pin 70, which is fixed in the through hole 43 of the insulator 40 as illustrated in FIGS. 3 and 4, has a retaining hole 71 at the side thereof for engaging the projection 46 of the insulator 40 and a cord clamping portion 72 which extends from the rear end thereof for clamping the cord 30 and for being electrically coupled to the cable core 31 of the cord 30. The cover 80 has an annular convex portion 81 on the inner side thereof as illustrated in FIG. 3. The annular convex portion 81 engages the annular groove 47 of the insulator 40 so that the cover 80 fixedly cover the outside of the insulator 40.

An example of assembling the thus constructed pin plug with word will be described hereinafter.

As illustrated in FIG. 4, the cord 30 piercing the cover 80 is clamped and held by the cord clamping portion 72. The cable core 31 of the cord 30 is coupled to the cord clamping portion 72 by crimping, spot welding, soldering, etc., while the cable sheath 32 of the cord 30 is coupled to the conductor clamping portion 62 of the metal contact piece 60 by being clamped thereby.

Figure 8:
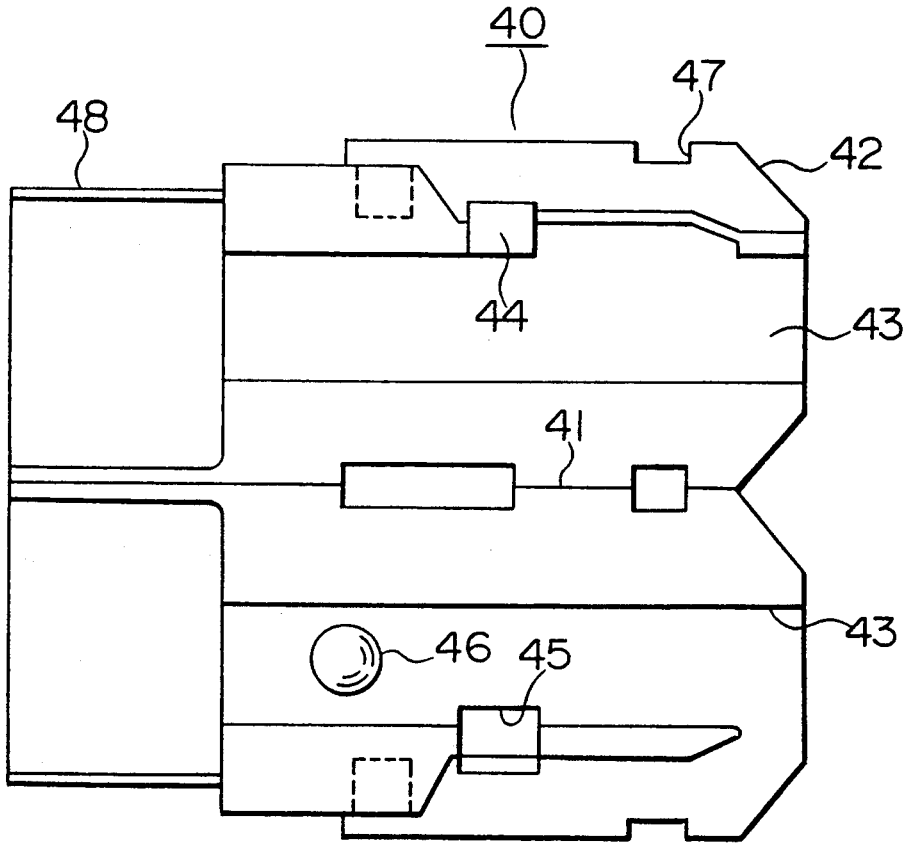
FIG. 8 is a view showing the development of the insulator of FIG. 7.

As illustrated in FIGS. 4 and 8, the insulator 40 having a two-partitioned structure is unfolded about the hinge portion 41, the center pin 70 is inserted into the through hole 43 of the insulator 40 and the projection 46 of the insulator 40 is allowed to engage the retaining hole 71 of the center pin 70. When the unfolded insulator 40 is folded at the hinge portion 41, the hook portion 44 of the insulator 40 engages the retaining hole 45 so as to fix the center pin 70 along the axis of the insulator 40.

Then, as illustrated in FIG. 5, the contact piece 60 is put on the opening 49 of the insulator 40 so as to allow the retaining convex portion 61 of the contact piece 60 engage the retaining recess portion 50 of the insulator 40, so that the contact piece 60 is fixed on the circumference of the sleeve portion 48 of the insulator 40 at the opening portion 49. Thereafter, the cover 80 is forced to put on the insulator 40 from the rear side thereof so that the annular convex portion 81 inside the cover 80 engages the annular groove 47 on the outside of the insulator 40. In this way the assembling of the pin plug with cord is completed.

When the thus assembled pin plug with cord is inserted into the jack 20 as illustrated in FIG. 1, the center pin 70 contacts the female contact 22 of the jack 20 while the sleeve portion 48 of the insulator 40 is inserted outside the sleeve 21 of the jack 20 so that the contact piece 60 provided on the circumference of the sleeve portion 48 at the opening portion 49 thereof is brought into contact with the sleeve 21 of the jack 20 and consequently the pin plug is electrically connected to the jack 20.

The pin plug according to the first embodiment has the following function and effect.

Figure 6:
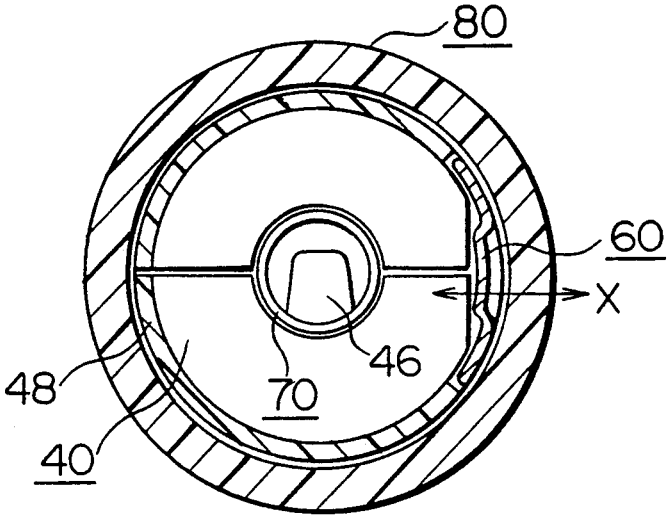
FIG. 6 is a cross-sectional view cut along B—B line VI—VI of the pin plug of FIG. 5.
Figure 7:
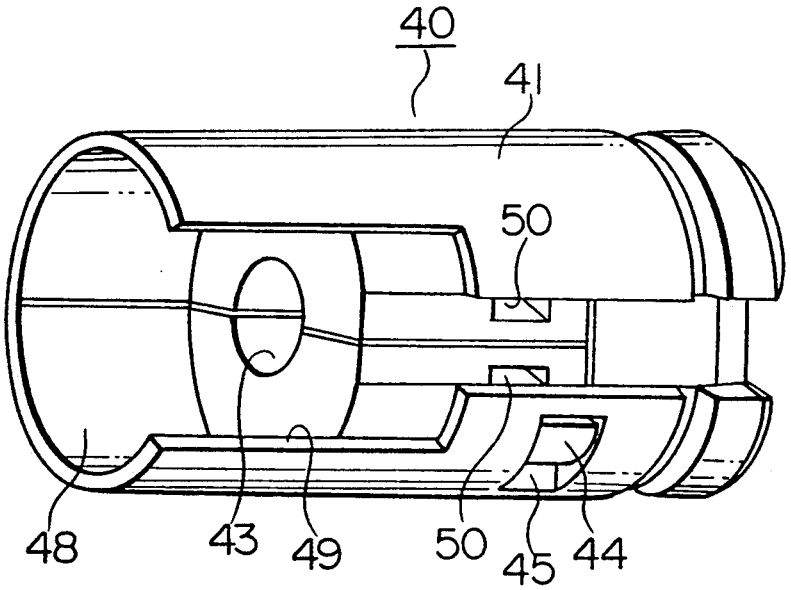
FIG. 7 is a perspective view of an insulator in the pin plug of FIG. 3.

(a) It is possible to form the cylindrical sleeve portion 48 having an accurate diameter with ease by manufacturing the insulator 40 by molding such as insert, i.e., pouring resin into a dye and hardening the same therein. When there is a variation of the diameter of the sleeve portion 48 due to manufacturing variation, etc., the diameter of the sleeve portion 48 is made a little larger than the outer diameter of the sleeve 21 of the jack 20. In that case, the contact piece 60 is pressed against the outside of the sleeve 21 by resiliency when the sleeve portion 48 of the insulator 40 is inserted outside the sleeve 21 of the jack 20. The contact piece 60 is superior to conventional sleeves 11 in resiliency owing to its structure, and moreover, it is covered by a non-rigid resin cover 80 at the outer surface thereof, so that the contact piece 60 is pressed in the centripetal direction of the insulator 40, i.e., in the radial direction X as illustrated in FIG. 6. As a result, a good electrical contact can be obtained between the sleeve 21 of the jack 20 and the contact piece 60 conjointly with the pressing force of the cover 80 and the insertion and extraction of the pin plug can be performed with ease.

In particular, inasmuch as the contact piece 60 is attached on the circumference of the cylindrical sleeve portion 48 at the opening portion thereof, it is possible to smoothly insert the sleeve portion 48 of the insulator 40 onto the sleeve 21 of the jack 20.

(b) Inasmuch as the sleeve portion 48 of the insulator 40 is made of resin, it is more corrosion-resistant than conventional metal sleeves 11.

(c) Inasmuch as the insulator 40 has a closable two-partitioned structure, the pin plug with cord can be easily assembled without any particular tool.

(d) An identification means is employed for identifying the connecting points by marking each plug etc. when a lot of pin plugs with cord are used in an electric instrument. In such case, it is possible to easily color the sleeve portion 48 of the insulator 40 for color identification of each pin plug since it is made of resin.

Figure 9:
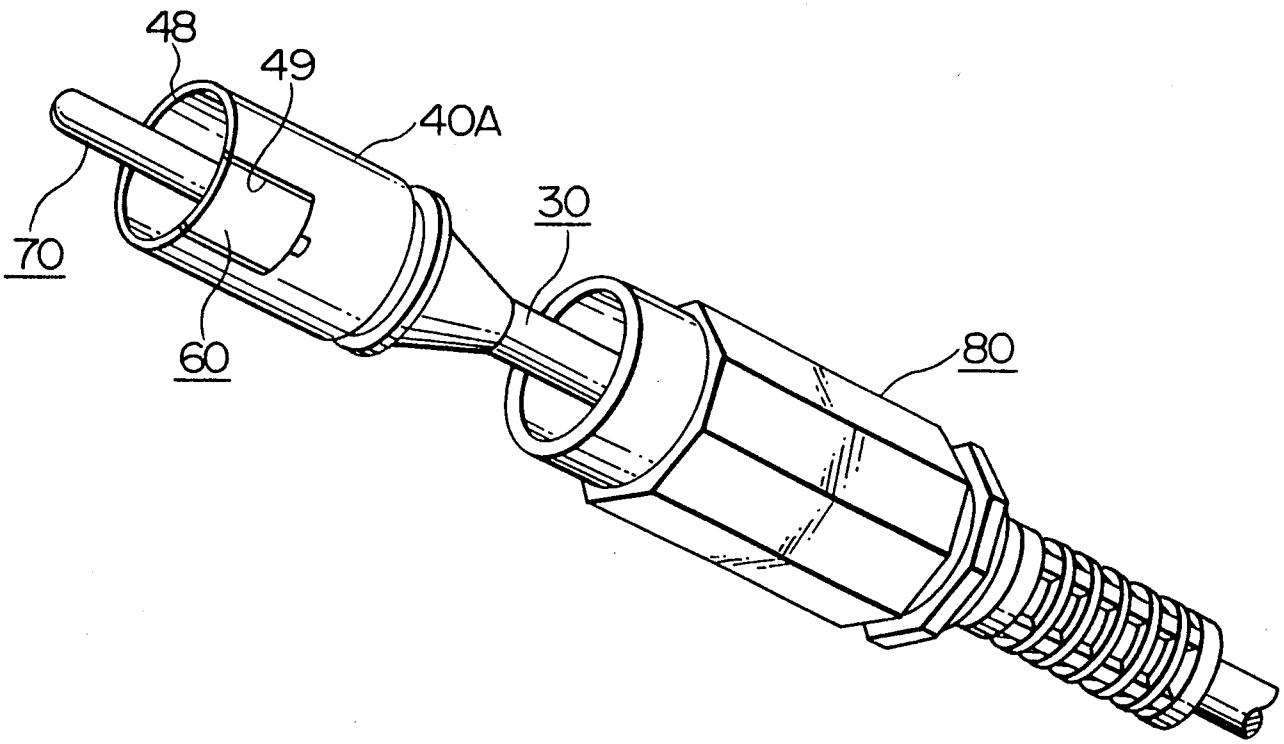
FIG. 9 is a perspective view showing a pin plug according to a second preferred embodiment of the present invention and FIG. 10 is a longitudinal cross-sectional view of the pin plug of FIG. 9.
Figure 10:
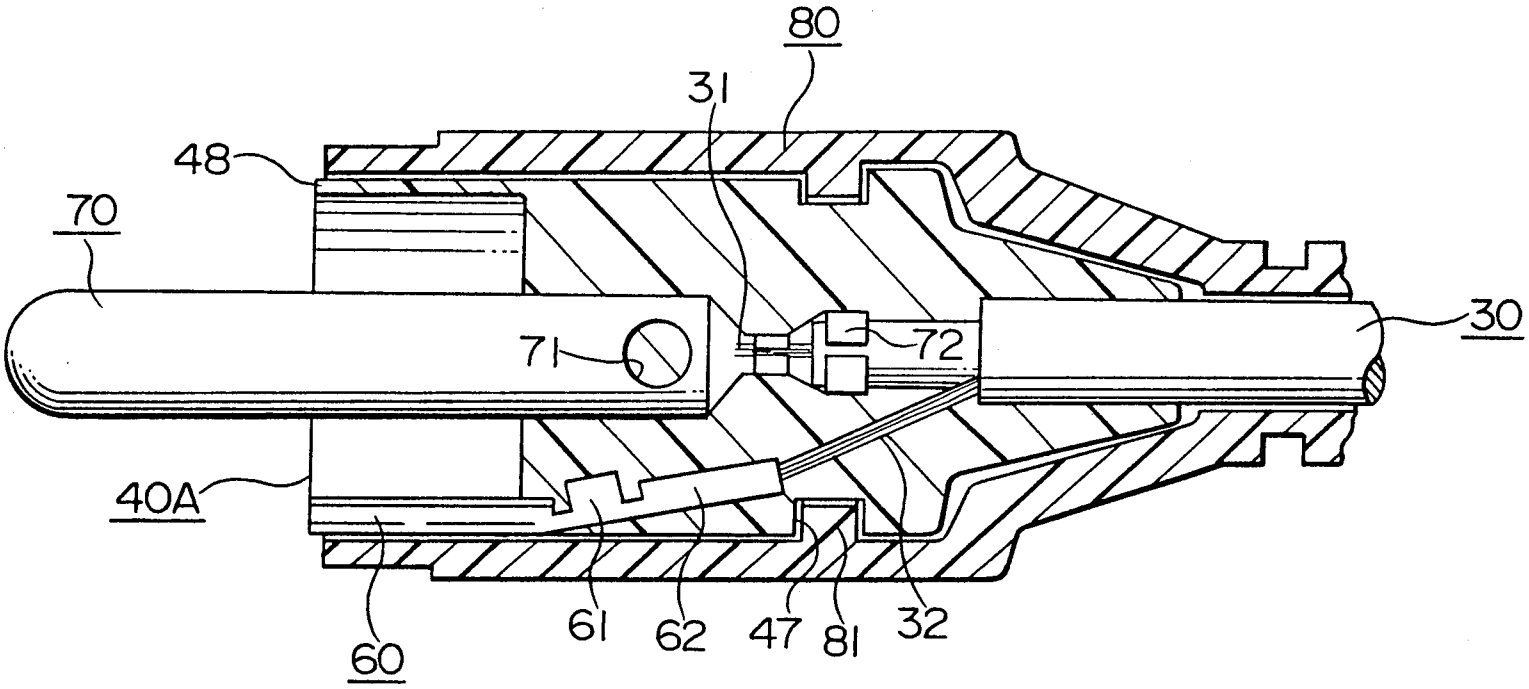

A pin plug according to the second embodiment of the present invention will be described hereinafter with reference to FIGS. 9 and 10, wherein the components which are common to those of the first embodiment in FIGS. 3 to 8 are denoted at the same numerals.

In the pin plug according to the second embodiment, the insulator 40 having a two-partitioned structure as illustrated in FIG. 3 is replaced by an insulator 40A integrally formed by a rigid resin such as polypropylene. Other elements are substantially same as those of FIG. 3.

The pin plug with cord according to the second embodiment is, for example, assembled as follows.

The cord 30 piercing the cover 80 is clamped by a cord clamping portion 72 of the center pin 70, while the cable core 31 is connected to the cord clamping portion 72 by crimping, spot welding, soldering, etc., and the cable sheath 32 is connected to the conductor clamping portion 62 of the metal contact piece 60 by crimping, etc. Thereafter molding process such as insert is performed. That is, the center pin 70 and the contact piece 60 are set in a die and melted rigid resin is poured into the die and is hardened therein so as to integrally form the insulator 40A having the cylindrical sleeve portion 48. The integrally formed insulator 40A fixes the center pin 70 and the contact piece 60. Thereafter the cover 80 is forced to be put on the insulator 40A from the rear side thereof so that the annular convex portion 81 of the cover 80 engages the annular groove 47 formed on the outside of the insulator 40A. In this way the assembling of the pin plug with cord is completed.

The pin plug with cord according to the second embodiment of the present invention not only have the function and effect substantially same as those of the first embodiment, but also facilitate the manufacturing process thereof since the cylindrical sleeve portion 48 and the insulator 40A having the opening portion 49 for attaching the contact piece 60 thereto can be integrally formed with ease by molding such as insert, etc., and at the same time the center pin 70 and the contact piece 60 can be fixed.

The above embodiments have been described in order to explain the technical contents of the present invention, and the present invention should not be limited to the embodiments set forth above and should not be understood in a narrow sense but can be varied in its application within the spirit of the invention and the scope of the claims. The modified embodiments are described hereinafter.

(i) The insulator 40 having a two-partitioned structure as illustrated in FIG. 3 etc., can be changed to other shapes. For example, the insulator 40 may have a separable two-partitioned structure omitting the hinge portion 41 thereof in FIG. 4 and FIG. 8, which is assembled by way of a connecting means, such as a combination of recess and convex portions formed on each of the contacting surfaces of the two partitions.

(ii) The contact piece 60 to be attached to the sleeve portion 48 of the insulators 40 and 40A can be changed in shape and attaching mechanism other than those illustrated in the drawings. Moreover, the cover 80 can be arbitrarily changed in shape in accordance with the external appearances of the insulators 40 and 40A.

What is claimed is:

1. A pin plug for connecting a cable having a first conductor and a second conductor, comprising:

a substantially cylindrical insulator body having a through hole formed therein and a cylindrical sleeve portion formed integrally with and extending from a tip end portion of said insulator body, said cylindrical insulator body comprising a first lateral portion and a second lateral portion, said insulator body being made of rigid resin;

said insulator body including an opening formed in a part of the circumference of said sleeve portion and said insulator body;

a metal center pin fixed in said through hole, a first end of said center pin projecting beyond said sleeve portion, a second end thereof being conductively connected to said second conductor;

a flexible metal contact piece conductively connected to said first conductor; said flexible metal contact piece being mounted in said opening so as to be substantially on the circumference of said sleeve portion and so as to be radially moveable relative to said sleeve portion; and a non-rigid resin cover engaged with the outside of the insulator body, the sleeve portion and the contact piece.

2. A pin plug as in claim 1, wherein said first lateral portion and said second lateral portion are pivotable about a hinge portion formed integrally with said first and second lateral portions.

3. A pin plug for connecting a cable having a first conductor and a second conductor, comprising:

a substantially cylindrical insulator body having a through hole formed therein;

a cylindrical sleeve portion formed integrally with and extending from a tip end portion of said insulator body;

said insulator body including an opening formed in a part of the circumference of said sleeve portion and a part of said insulator body;

a metal center pin fixed in said through hole, a first end of said center pin extending beyond said sleeve portion, a second end thereof being conductively connected to said second conductor;

a flexible metal contact piece conductively connected to said first conductor; said contact piece being mounted in said opening so as to be substantially on the circumference of the sleeve portion and so as to be radially movable relative to said sleeve portion;

said insulator body being molded of a rigid resin thereby securing the center pin and the contact piece; and a non-rigid resin cover engaged with the outside of the insulator body, the sleeve portion and the contact piece.

* * * * *